US007195468B2

(12) United States Patent
Um

(10) Patent No.: US 7,195,468 B2
(45) Date of Patent: Mar. 27, 2007

(54) SCROLL COMPRESSOR HAVING FRAME FIXING STRUCTURE AND FRAME FIXING METHOD THEREOF

(75) Inventor: Kwang-No Um, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/008,992

(22) Filed: Dec. 13, 2004

(65) Prior Publication Data

US 2006/0127260 A1 Jun. 15, 2006

(51) Int. Cl.
*F01C 1/02* (2006.01)
*F03C 2/00* (2006.01)

(52) U.S. Cl. ..... 418/55.1; 418/1; 417/902; 29/888.022

(58) Field of Classification Search ..... 418/55.1–55.5, 418/57; 417/310, 902; 29/888.022
See application file for complete search history.

(56) References Cited

U.S. PATENT DOCUMENTS 5,176,506 A * 1/1993 Siebel ..... 418/94
5,267,844 A * 12/1993 Grassbaugh et al. ..... 418/55.1
5,547,355 A * 8/1996 Watanabe et al. ..... 418/55.5
6,884,046 B2 * 4/2005 Matsukawa et al. ..... 418/55.1

FOREIGN PATENT DOCUMENTS

JP 06264883 A * 9/1994
JP 08021376 A * 1/1996
JP 11141469 A * 5/1999
JP 2001-50163 A 2/2001
KR 1997-0003680 Y1 4/1997

* cited by examiner

*Primary Examiner*—Theresa Trieu
(74) *Attorney, Agent, or Firm*—Birch, Stewart, Kolasch & Birch, LLP

(57) ABSTRACT

Disclosed are a scroll compressor having a frame fixing structure and a frame fixing method of the scroll compressor. The scroll compressor comprises an upper frame installed at an inner upper portion of a hermetic container; a fixed scroll fixed to an upper portion of the upper frame; and an orbiting scroll orbitably installed between the fixed scroll and the upper frame, wherein a joining groove is formed at a lateral surface of the upper frame, a curved portion having a penetration hole is formed at a lateral surface of the hermetic container corresponding to the joining groove, and a welding portion fixes the hermetic container and the upper frame through the penetration hole.

15 Claims, 5 Drawing Sheets

SCROLL COMPRESSOR HAVING FRAME FIXING STRUCTURE AND FRAME FIXING METHOD THEREOF

BACKGROUND OF THE INVENTION

1. Field of the Invention

The present invention relates to a scroll compressor, and more particularly, to a scroll compressor having a frame fixing structure capable of easily and firmly fixing a frame to a hermetic container, and a frame fixing method of the scroll compressor.

2. Description of the Conventional Art

Generally, a compressor is a device for converting mechanical energy into compression energy of a compression fluid. The compressor is divided into a reciprocating compressor, a scroll compressor, a centrifugal compressor, and a vane compressor.

The scroll compressor sucks, compresses, and discharges gas by using a rotation body like the centrifugal compressor and the vane compressor differently from the reciprocating compressor using a linear motion of a piston.

FIG. 1 is a longitudinal section view showing a scroll compressor in accordance with the conventional art, and FIG. 2 is an enlargement section view of 'A' part of FIG. 1.

As shown, an upper frame 2 is fixed to an inner upper portion of a hermetic container 1 having an accommodation space therein, and a lower frame 3 is fixed to an inner lower portion of the hermetic container 1.

A motor 6 composed of a stator 4 and a rotor 5 rotatably coupled to an inner side of the stator 4 is installed between the upper frame 2 and the lower frame 3. A balance weight for controlling an unbalanced rotation of the rotor 5 is mounted at upper and lower portions of the rotor 5.

A rotation shaft 7 rotated together with the rotor 5 is forcibly pressed into an axial hole 5*a* formed at a center of the rotor 5 in a vertical direction. An upper end portion of the rotation shaft 7 coupled to the rotor 5 is rotatably inserted into a supporting hole 2*a* of the upper frame 2, and a lower end portion of the rotation shaft 7 is rotatably inserted into a supporting hole 3*a* of the lower frame 3.

A compression unit 10 composed of a fixed scroll 8 fixed to the upper frame 2 and an orbiting scroll 9 rotatably coupled between the fixed scroll 8 and the upper frame 2 is installed at an upper side of the upper frame 2. An eccentric portion 7*a* formed at the upper end portion of the rotation shaft 7 to be eccentric is inserted into a coupling hole 11*a* of a boss portion 11 formed at a lower end portion of the orbiting scroll 9.

An oil feeder 13 for sucking oil 12 contained in a lower portion of the hermetic container 1 and supplying the oil to a frictional part of the compression unit 10 through an oil passage 7*b* formed at the rotation shaft 7 is coupled to a lower end portion of the rotation shaft 7.

A suction pipe 14 for sucking refrigerant gas and a discharge pipe 15 for discharging compressed refrigerant gas are installed at a lateral surface of the hermetic container 1 with a height difference. Also, a pressure separating plate 16 for separating a low pressure portion 20 where refrigerant gas sucked into the hermetic container 1 through the suction pipe 14 exists from a high pressure portion 21 where the refrigerant gas sucked into the hermetic container 1 is compressed in the compression unit 10 and stays before being discharged through the discharge pipe 15 is fixed to an upper portion of the fixed scroll 8.

A check valve 19 for preventing refrigerant gas discharged through a discharge hole 8*a* formed at the fixed scroll 8 from backward flowing is coupled to an upper surface of the fixed scroll 8.

An unexplained reference numeral 8*b* denotes a wrap of the fixed scroll, 8*c* denotes a refrigerant suction hole, 9*a* denotes a wrap of the orbiting scroll, 16*a* denotes a discharge hole, 30 denotes a rotation preventing member, and P denotes a compression pocket.

In the scroll compressor, when power is supplied to the scroll compressor, the rotor 5 of the motor 6 is rotated and thereby the rotation shaft 7 is rotated. According to this, the orbiting scroll 9 coupled to the upper end portion of the rotation shaft 7 is rotated.

The orbiting scroll 9 is orbited by having an eccentric distance from a center of the rotation shaft 7 to a center of the eccentric portion 7*a* as a radius, and the orbiting scroll 9 is prevented from being rotated by the rotation preventing member 30.

When the orbiting scroll 9 is orbited, the wrap 9*a* is orbited by being engaged with the wrap 8*b* of the fixed scroll 8. At this time, refrigerant gas is introduced into the lower pressure portion 20 of the hermetic container 1 through the suction pipe 14. Then, the refrigerant gas is introduced into the compression pocket P formed between the wrap 8*b* of the fixed scroll 8 and the wrap 9*a* of the orbiting scroll 9 through the refrigerant suction hole 8*c* formed at the fixed scroll 8. As the orbiting scroll 9 is continuously orbited, a volume of the compression pocket P is decreased and the refrigerant gas is compressed. At this time, the compressed gas moves towards a center portion of the compression pocket P, and is discharged out through the discharge hole 8*a* of the fixed scroll 8.

While the compression operation is performed, oil 12 contained in the inner lower portion of the hermetic container 1 is sucked by the oil feeder 13 together rotated with the rotation shaft 7. The sucked oil 12 is supplied to the compression unit 10 through the oil passage 7*b*.

As shown in FIG. 2, under a state that a welding pin 21 is inserted into a pin inserting groove 2*b* formed at a lateral surface of the upper frame 2, the welding pin 21 is welded to the hermetic container 1 by a welding portion W penetrating a through hole 1*a* of the hermetic container 1.

However, in the conventional scroll compressor, since the upper frame 2 is not directly fixed to the hermetic container 1 but is fixed to the hermetic container 1 by the welding pin 21, a welded portion of the upper frame is weak. According to this, the welded portion between the upper frame and the hermetic container is easily detached from each other due to vibration generated when the compressor is driven.

SUMMARY OF THE INVENTION

Therefore, an object of the present invention is to provide a scroll compressor having a frame fixing structure capable of directly and firmly fixing a frame to a hermetic container by inserting an inner circumferential surface of a penetration hole formed at the hermetic container into a joining groove formed at a lateral surface of the frame by a plastic working and then performing a welding process and thereby capable of preventing a joined portion between the frame and the hermetic container from being detached from each other due to vibration generated when the compressor is driven, and a frame fixing method of the scroll compressor.

To achieve these and other advantages and in accordance with the purpose of the present invention, as embodied and broadly described herein, there is provided a scroll compressor having a frame fixing structure comprising: an upper frame installed at an inner upper portion of a hermetic container; a fixed scroll fixed to an upper portion of the upper frame; and an orbiting scroll orbitably installed between the fixed scroll and the upper frame, wherein a joining groove is formed at a lateral surface of the upper frame, a curved portion having a penetration hole is formed at a lateral surface of the hermetic container corresponding to the joining groove, and a welding portion for fixing the hermetic container and the upper frame through the penetration hole is formed.

A frame fixing method of a scroll compressor comprises the steps of: forming a joining groove at a lateral surface of a frame; forming a penetration hole at a lateral surface of a hermetic container corresponding to the joining groove; forming a curved portion by bending the periphery of the penetration hole towards an inner side of the joining groove; and welding the frame to the hermetic container.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a scroll compressor having a frame fixing structure according to the present invention will be explained with reference to the attached drawings as follows.

Figure 1:
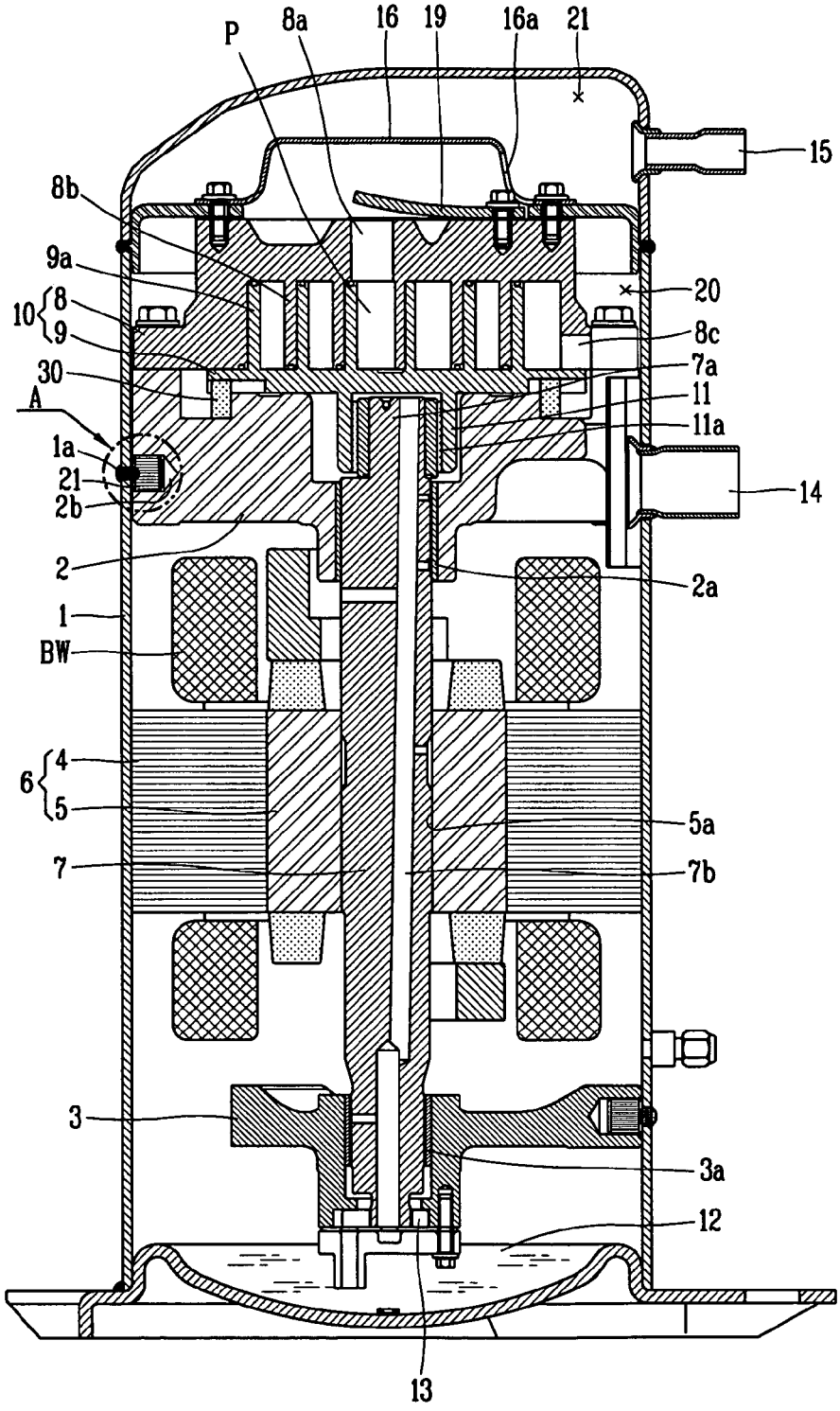
FIG. 1 CONVENTIONAL ART
FIG. 1 is a longitudinal section view showing a scroll compressor in accordance with the conventional art.
Figure 2:
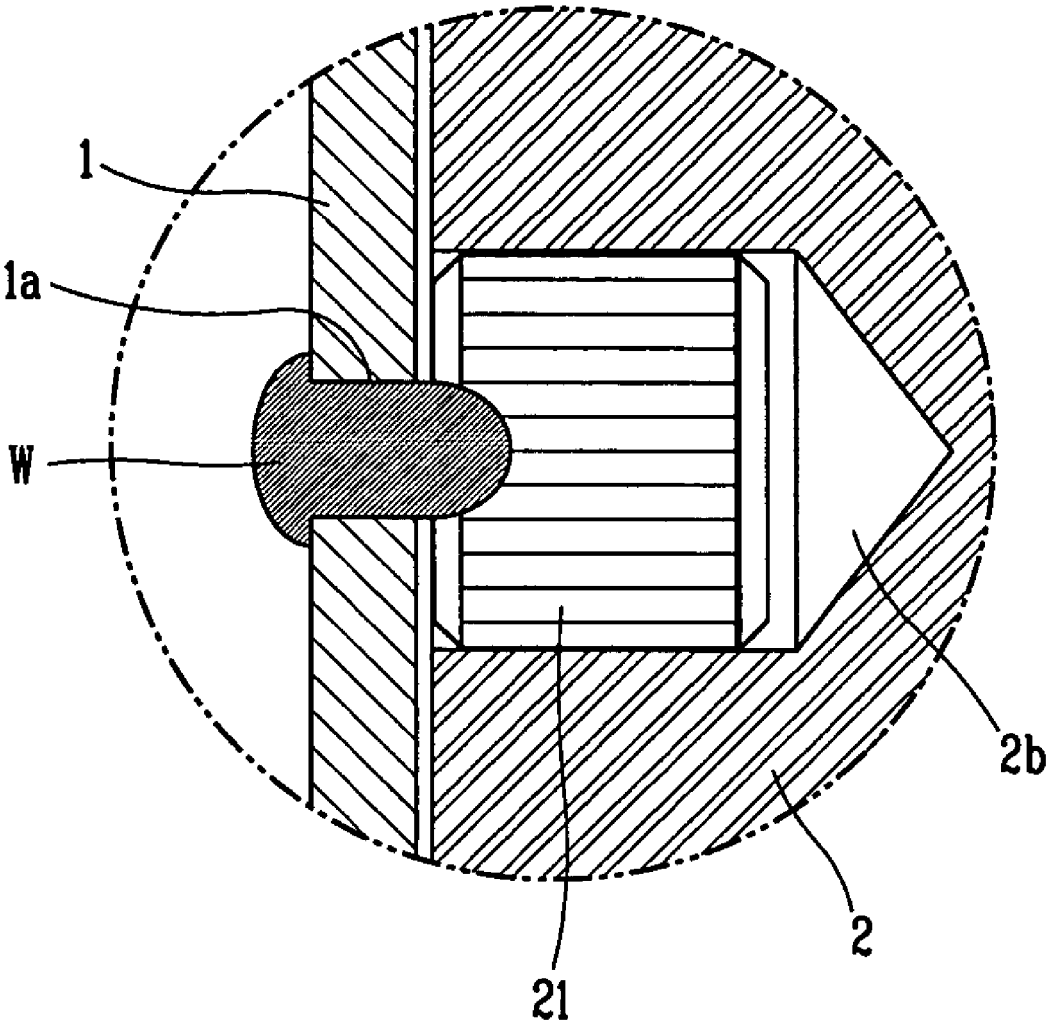
FIG. 2 CONVENTIONAL ART
FIG. 2 is an enlargement section view of 'A' part of FIG. 1.
Figure 3:
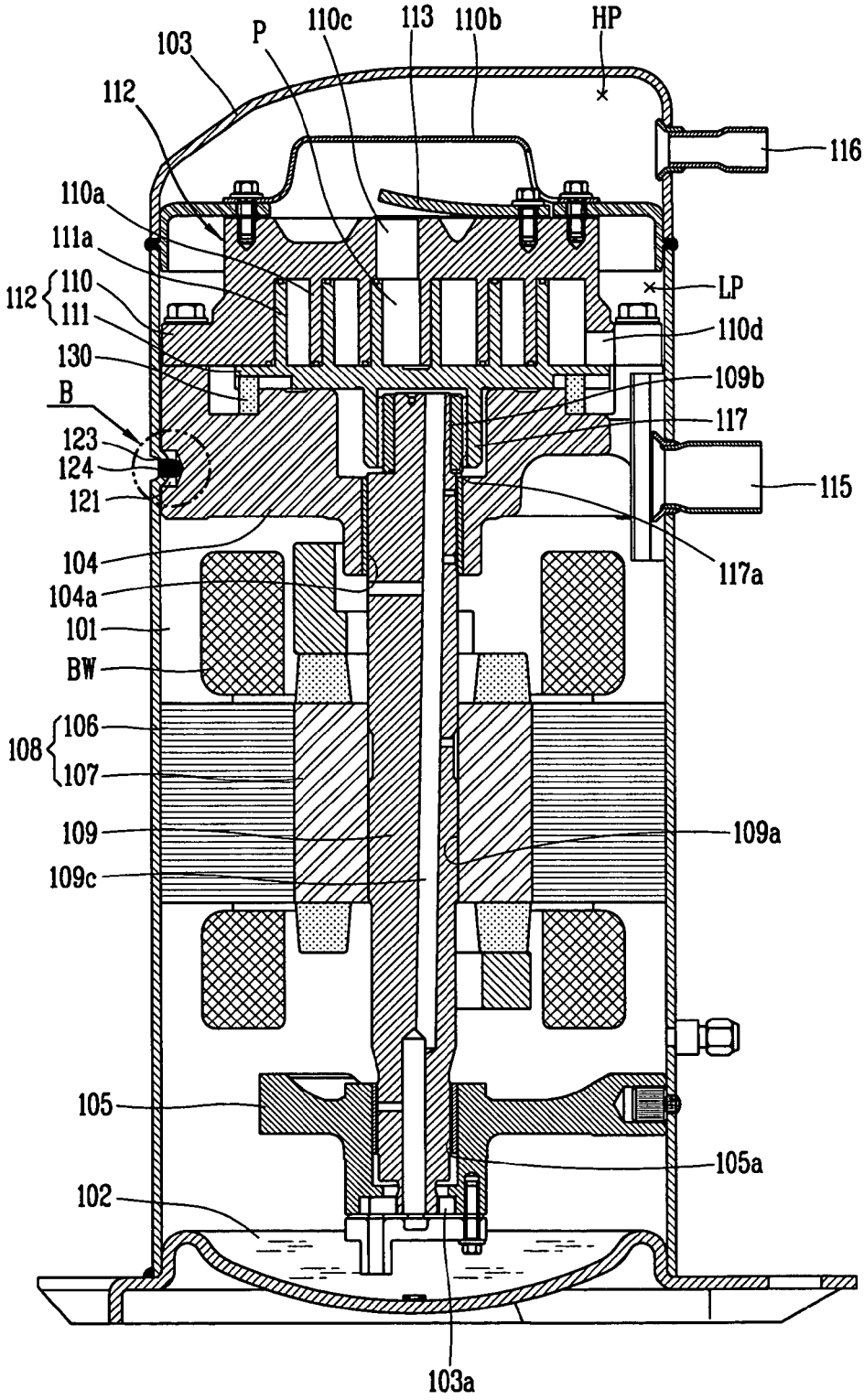
FIG. 3 is a longitudinal section view of a scroll compressor having a frame fixing structure according to the present invention.
Figure 4:
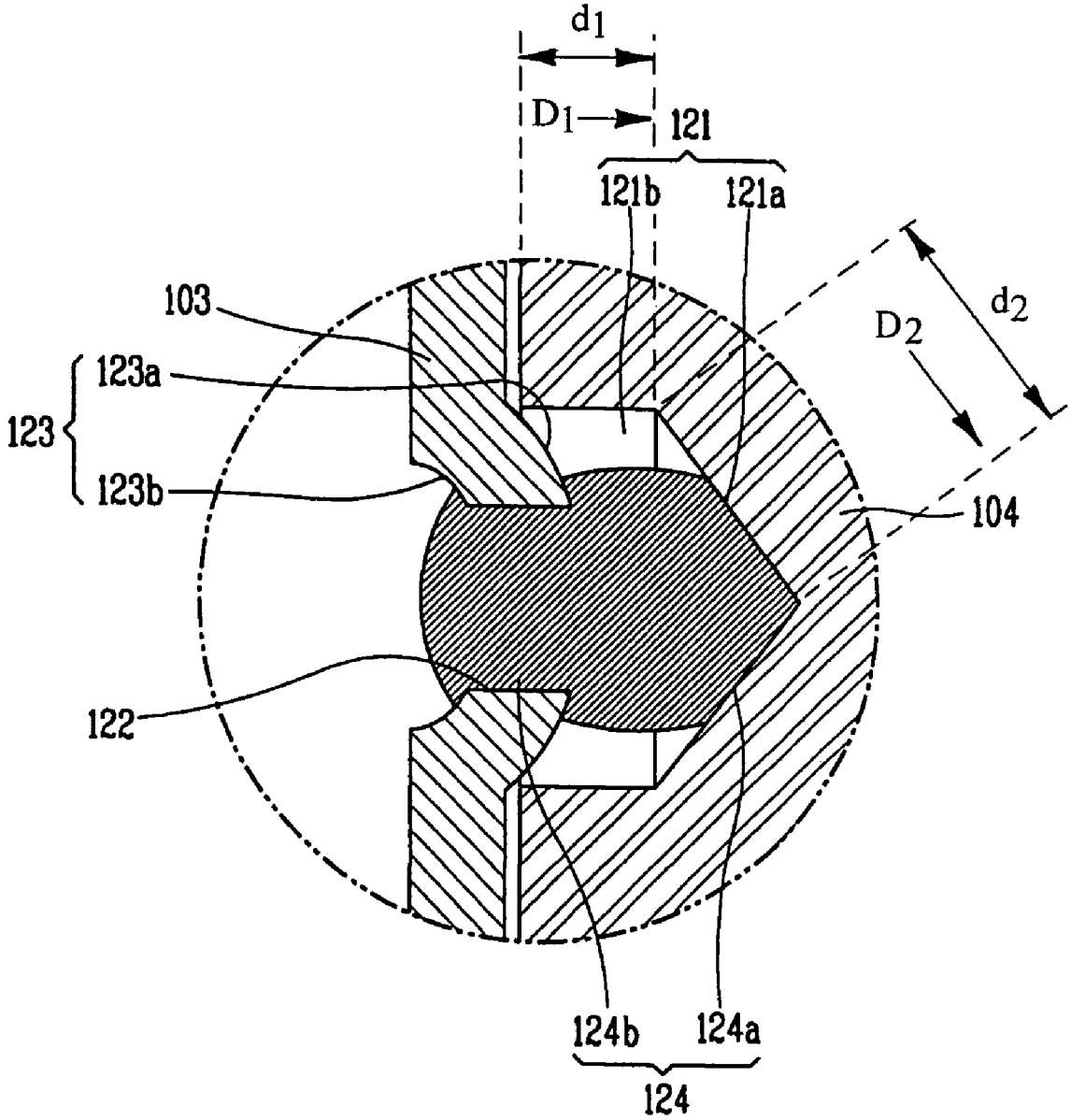
FIG. 4 is an enlargement section view of 'B' part of FIG. 3.

FIG. 3 is a longitudinal section view showing a scroll compressor having a frame fixing structure according to the present invention, and FIG. 4 is an enlargement section view of 'B' part of FIG. 3.

As shown, in the scroll compressor having a frame fixing structure according to the present invention, an upper frame 104 is fixed to an inner upper portion of a hermetic container 103 having an accommodation space 101 therein, and a lower frame 105 is fixed to an inner lower portion of the hermetic container 103.

A motor 108 composed of a stator 106 and a rotor 107 rotatably coupled to an inner side of the stator 106 is installed between the upper frame 104 and the lower frame 105.

A balance weight BW for controlling an unbalanced rotation of the rotor 107 is mounted at upper and lower portions of the rotor 107.

A rotation shaft 109 rotated together with the rotor 107 is forcibly pressed into an axial hole 109*a* formed at a center of the rotor 107 in a vertical direction. An upper end portion of the rotation shaft 109 coupled to the rotor 107 is rotatably inserted into a supporting hole 104*a* of the upper frame 104, and a lower end portion of the rotation shaft 109 is rotatably inserted into a supporting hole 105*a* of the lower frame 105.

A compression unit 112 composed of a fixed scroll 110 fixed to the upper frame 104 and an orbiting scroll 111 rotatably coupled between the fixed scroll 110 and the upper frame 104 is installed at an upper side of the upper frame 104. An eccentric portion 109*b* formed at the upper end portion of the rotation shaft 109 to be eccentric is inserted into a coupling hole 117*a* of a boss portion 117 formed at a lower end portion of the orbiting scroll 111.

An oil feeder 103*a* for sucking oil 102 contained in a lower portion of the hermetic container 103 and supplying the oil to a frictional part of the compression unit 112 through an oil passage 109*c* formed at the rotation shaft 109 is coupled to a lower end portion of the rotation shaft 109.

A suction pipe 115 for sucking refrigerant gas and a discharge pipe 116 for discharging compressed refrigerant gas are installed at a lateral surface of the hermetic container 103 with a height difference. Also, a pressure separating plate 110*b* for separating a low pressure portion LP 20 where refrigerant gas sucked into the hermetic container 103 through the suction pipe 115 exists from a high pressure portion HP 21 where the refrigerant gas sucked into the hermetic container 103 is compressed in the compression unit 112 and stays before being discharged through the discharge pipe 116 is fixed to an upper portion of the fixed scroll 110.

A check valve 113 for preventing refrigerant gas discharged through a discharge hole 110*c* formed at the fixed scroll 110 from backward flowing is coupled to an upper surface of the fixed scroll 110.

A joining groove 121 is formed at a lateral surface of the upper frame 104, and a curved portion 123 having a penetration hole 122 is formed at a lateral surface of the hermetic container 103 corresponding to the joining groove 121. Also, a welding portion 124 fixes the hermetic container 103 and the upper frame 104 through the penetration hole 122.

The joining groove 121 is divided into an end portion 121*a* and an entrance portion 121*b*. The entrance portion 121b is formed to have the same diameter, and a diameter of the end portion 121*a* is gradually decreased. As seen in FIG. 4, the entrance portion 121*b* extends inwards of the upper frame 104 for a first distance $d_1$ in a first direction $D_1$ and the end portion 121*a* extends inward of the entrance portion 121*b* for a second distance $d_2$ in a second direction $D_2$ different from the first direction $D_1$.

An inner surface 123*a* of the curved portion 123 is protruded towards an inner side of the joining groove 121, and an outer surface 123*b* of the curved portion 123 is concaved towards an inner side of the hermetic container 103 on the basis of the penetration hole 122.

A part of the curved portion 123 is bent towards the inner side of the joining groove 121 by a plastic working. Under this state, one end 124*a* of the welding portion 124 is fixed to the end portion 121*a* through the penetration hole 122, and another end 124*b* of the welding portion 124 is fixed to the curved portion 123, thereby firmly fixing the upper frame 104 to the hermetic container 103.

An unexplained reference numeral 110*a* denotes a wrap of the fixed scroll, 110*d* denotes a refrigerant suction hole, 111*a* denotes a wrap of the orbiting scroll, 30 denotes a rotation preventing member, and P denotes a compression pocket.

In the scroll compressor according to the present invention, as power is supplied to the scroll compressor, the rotor 107 of the motor 108 is rotated and thereby the rotation shaft 109 forcibly inserted into the rotor 107 is rotated. According to this, the orbiting scroll 111 coupled to the eccentric portion 109*b* formed at the upper end portion of the rotation shaft 109 is rotated. The orbiting scroll 111 is orbited by having an eccentric distance from a center of the rotation shaft 109 to a center of the eccentric portion 109*b* as a radius, and the orbiting scroll 111 is prevented from being rotated by the rotation preventing member 130.

When the orbiting scroll 111 is orbited, the wrap 111*a* is orbited by being engaged with the wrap 110*a* of the fixed scroll 110. At this time, refrigerant gas is introduced into the lower pressure portion LP of the hermetic container 103 through the refrigerant suction pipe 115. Then, the refrigerant gas is introduced into the compression pocket P formed between the wrap 110*a* of the fixed scroll 110 and the wrap 111*a* of the orbiting scroll 111 through the refrigerant suction hole 110*d* formed at the fixed scroll 110. As the orbiting scroll 111 is continuously orbited, a volume of the compression pocket P is decreased and the refrigerant gas is compressed. At this time, the compressed gas moves towards a center portion of the compression pocket P thereby to be discharged through the discharge hole 110*c* of the fixed scroll 110, and then is discharged to the high pressure portion HP.

In the scroll compressor of the present invention, under a state that the curved portion 123 of the hermetic container 103 is inserted into the joining groove 121 formed at the upper frame 104, the upper frame 104 is welded to the hermetic container 103 more firmly. According to this, a detachment of a joined part between the upper frame 104 and the hermetic container 103 due to vibration generated when the compressor is driven is effectively prevented. The present invention can be applied not only to a fixing structure of the upper frame 104 but also to a fixing structure of the lower frame 105.

Figure 5A:
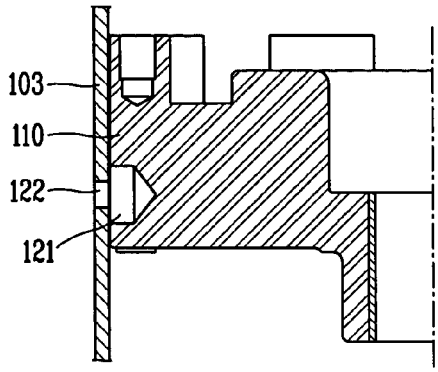
FIGS. 5A to 5C are longitudinal section views of the scroll compressor for explaining a frame fixing method of the scroll compressor according to the present invention.
Figure 5B:
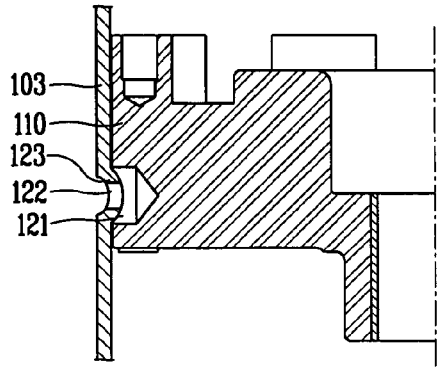
Figure 5C:
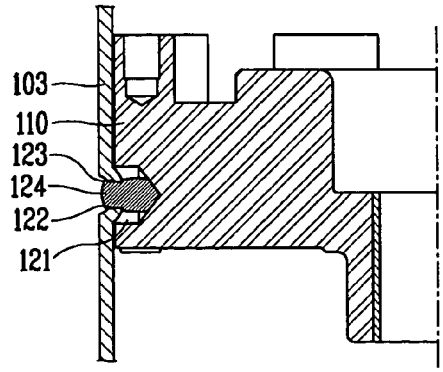

FIGS. 5A to 5C are longitudinal section views of the scroll compressor according to the present invention for explaining a frame fixing process.

A frame fixing method of a scroll compressor according to the present invention comprises: a first step of forming the joining groove 121 at a lateral surface of the upper frame 104 (Refer to FIG. 5A); a second step of forming the penetration hole 122 at a lateral surface of the hermetic container 103 corresponding to the joining groove 121 (Refer to FIG. 5A); a third step of forming the curved portion 123 by bending the periphery of the penetration hole 122 towards an inner side of the joining groove 121 (Refer to FIG. 5B); and a fourth step of welding the upper frame 104 to the hermetic container 103 (Refer to FIG. 5C).

In the first step, it is possible to form at least one joining groove 121 at a lateral surface of the upper frame 104 with a certain interval. In the third step, it is preferable to form the curved portion 123 by using a plastic working.

As aforementioned, in the scroll compressor according to the present invention, under an inner circumferential surface of the penetration hole formed at the hermetic container is inserted into the joining groove formed at a lateral surface of the frame by a plastic working and then a welding process is performed. According to this, the frame is directly and firmly fixed to the hermetic container, and thereby a joined portion between the frame and the hermetic container is prevented from being detached from each other due to vibration generated when the compressor is driven.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A scroll compressor having a frame fixing structure comprising:

an upper frame installed at an inner upper portion of a hermetic container;

a fixed scroll fixed to an upper portion of the upper frame; and an orbiting scroll located between the fixed scroll and the upper frame, wherein a joining groove is formed at a lateral surface of the upper frame, a curved portion having a penetration hole is formed at a lateral surface of the hermetic container corresponding to the joining groove, and a welding portion fixes the hermetic container and the upper frame through the penetration hole, and wherein the joining groove is divided into an entrance portion extending inwards of the upper frame for a first distance in a first direction and an end portion that extends inward of the entrance portion for a second distance in a second direction different from the first direction.

2. The scroll compressor of claim 1, wherein the entrance portion has a generally constant cross-section for the length of the first distance and the end portion has a cross-section that decreases in size along the length of the second distance.

3. The scroll compressor of claim 1, wherein at least one joining groove is formed.

4. The scroll compressor of claim 1, wherein a part of the curved portion is bent towards an inner side of the joining groove.

5. The scroll compressor of claim 4, wherein an inner surface of the curved portion is protruded towards an inner side of the joining groove, and an outer surface of the curved portion is concaved towards an inner side of the hermetic container on the basis of the penetration hole.

6. A scroll compressor having a frame fixing structure of a compressor, the compressor having a hermetic container and an upper frame installed at an inner upper portion of the hermetic container, the frame fixing structure comprising:

a joining groove formed at a lateral surface of the upper frame;

a curved portion having a penetration hole formed at a lateral surface of the hermetic container corresponding to the joining groove; and a welding portion fixing the hermetic container and the upper frame through the penetration hole, wherein the joining groove is divided into an entrance portion extending inwards of the upper frame for a first distance in a first direction and an end portion that extends inward of the entrance portion for a second distance in a second direction different from the first direction.

7. The frame fixing structure of claim 6, wherein the entrance portion has a generally constant cross-section for the length of the first distance and the end portion has a cross-section that decreases in size along the length of the second distance.

8. The frame fixing structure of claim 6, wherein at least one joining groove is formed.

9. The frame fixing structure of claim 6, wherein a part of the curved portion is bent towards an inner side of the joining groove.

10. The frame fixing structure of claim 6, wherein an inner surface of the curved portion is protruded towards an inner side of the joining groove, and an outer surface of the curved portion is concaved towards an inner side of the hermetic container on the basis of the penetration hole.

11. A frame fixing method of a compressor comprising the steps of:

forming a joining groove at a lateral surface of a frame, the joining groove being divided into an entrance portion extending inwards of the frame for a first distance in a first direction and an end portion that extends inward of the entrance portion for a second distance in a second direction different from the first direction;

forming a penetration hole at a lateral surface of a hermetic container corresponding to the joining groove;

forming a curved portion by bending a peripheral portion of the penetration hole towards an inner side of the joining groove; and welding the frame to the hermetic container through the penetration hole.

12. The method of claim 11, wherein the curved portion is formed by using a plastic working.

13. A scroll compressor having a frame fixing structure comprising:

an upper frame installed at an inner upper portion of a hermetic container;

a fixed scroll fixed to an upper portion of the upper frame; and an orbiting scroll located between the fixed scroll and the upper frame, wherein a joining groove is formed at a lateral surface of the upper frame, a curved portion having a penetration hole is formed at a lateral surface of the hermetic container corresponding to the joining groove, and a welding portion fixes the hermetic container and the upper frame through the penetration hole, wherein an inner surface of the curved portion is protruded towards an inner side of the joining groove, and an outer surface of the curved portion is concaved towards an inner side of the hermetic container on the basis of the penetration hole.

14. A frame fixing structure of a compressor, the compressor having a hermetic container and an upper frame installed at an inner upper portion of the hermetic container, the frame fixing structure comprising:

a joining groove formed at a lateral surface of the upper frame;

a curved portion having a penetration hole formed at a lateral surface of the hermetic container corresponding to the joining groove; and a welding portion fixing the hermetic container and the upper frame through the penetration hole, wherein an inner surface of the curved portion is protruded towards an inner side of the joining groove, and an outer surface of the curved portion is concaved towards an inner side of the hermetic container on the basis of the penetration hole.

15. A frame fixing method of a compressor comprising the steps of:

forming a joining groove at a lateral surface of a frame;

forming a penetration hole at a lateral surface of a hermetic container corresponding to the joining groove;

forming a curved portion having an inner surface which protrudes towards an inner side of the joining groove, and an outer surface concaved towards an inner side of the hermetic container on the basis of the penetration hole by bending a peripheral portion of the penetration hole towards an inner side of the joining groove; and welding the frame to the hermetic container through the penetration hole.

* * * * *